United States Patent [19]

Evans

[11] Patent Number: 4,857,024

[45] Date of Patent: Aug. 15, 1989

[54] SWIM FIN WITH FLEXIBLE FIN MEMBER HAVING MOVABLE TIPS

[76] Inventor: Robert B. Evans, 28 Anacapa St., Santa Barbara, Calif. 93101

[21] Appl. No.: 747,973

[22] Filed: Jun. 21, 1985

Related U.S. Application Data

[63] Continuation of Ser. No. 311,436, Oct. 14, 1981, abandoned.

[51] Int. Cl.[4] ..... A63B 31/08

[52] U.S. Cl. ..... 441/64

[58] Field of Search ..... 441/64, 61; D21/239

[56] References Cited

U.S. PATENT DOCUMENTS

| | | | |
|---|---|---|---|
| 2,423,571 | 7/1947 | Wilen | 441/64 |
| 3,055,025 | 9/1962 | Ferraro et al. | 441/64 |

FOREIGN PATENT DOCUMENTS

| | | | |
|---|---|---|---|
| 1245395 | 9/1960 | France | 441/64 |
| 1322734 | 2/1963 | France | 441/64 |

OTHER PUBLICATIONS

"Force Fin", *Skindiver*; Jan. 1982, pp. 38–39.

*Primary Examiner*—Joseph F. Peters, Jr.
*Assistant Examiner*—Jesûs D. Sotelo

[57] ABSTRACT

A swim fin adapted to be mounted on a foot of a swimmer including a foot receiving portion having a substantially planar base section terminating at one end thereof in a heel section which extends downwardly therefrom and which terminates at the other end thereof in an open toe section and an elongated flexible fin member formed of a resilient material and which extends from the open toe section and which is integral with the substantially planar base section of the foot receiving portion wherein the elongated flexible fin member is generally trapezoidal in shape with the smaller end thereof contiguous the open toe section of the foot receiving portion and with the longest end of the elongated flexible fin member forming a deflecting end which terminates in a pair of movable tips wherein the cross-sectional shape of the elongated flexible fin member in a direction which is normal to the center line extending substantially perpendicular from the smaller end to the deflectable end which is thicker at the center thereof and which tapers in thickness therefrom to each side of the elongated flexible fin member to define a relatively thin edge wherein the flexible fin member is capable of being deflected toward the open toe section and then to be abruptly reversed in a direction to deflect the flexible fin member towards the heel section of the foot receiving portion which reverses the direction of the deflectable end of the flexible fin member and moves the movable tips along an arcuate shaped path causing a snapping action thereof.

11 Claims, 5 Drawing Sheets

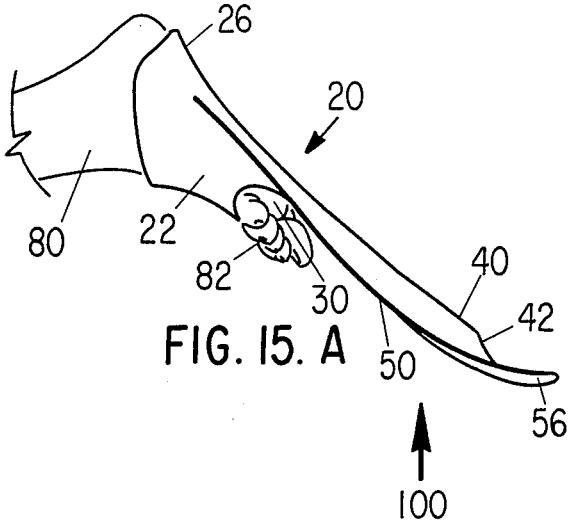
FIG. 15. A
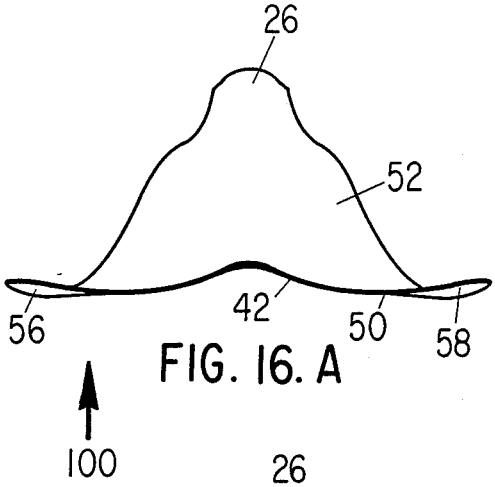
FIG. 16. A
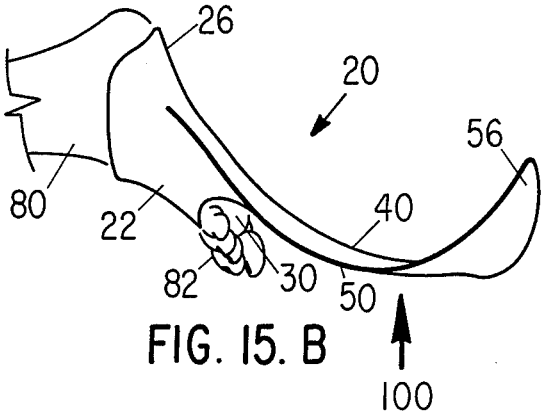
FIG. 15. B
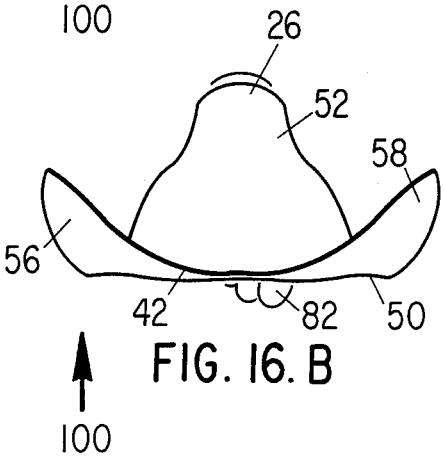
FIG. 16. B
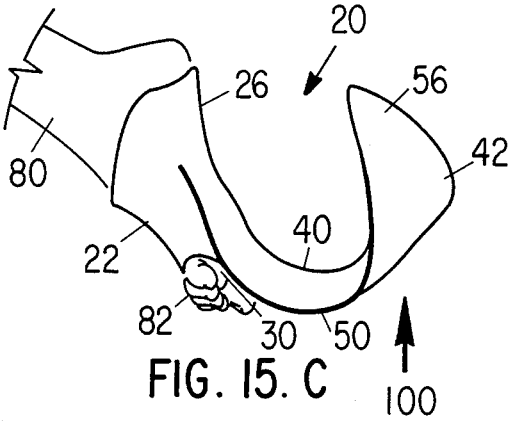
FIG. 15. C
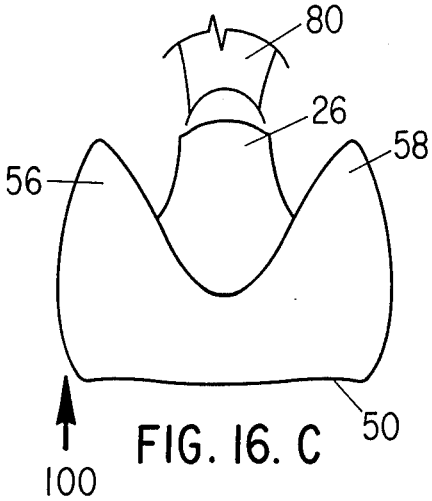
FIG. 16. C

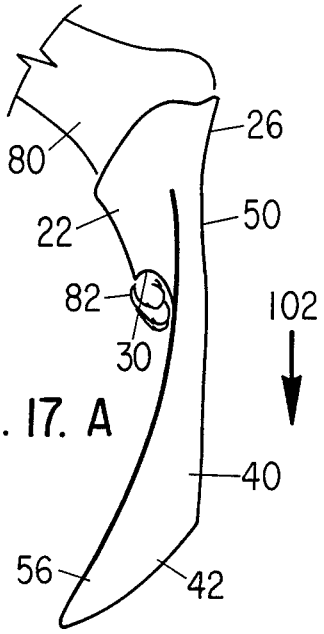
FIG. 17. A
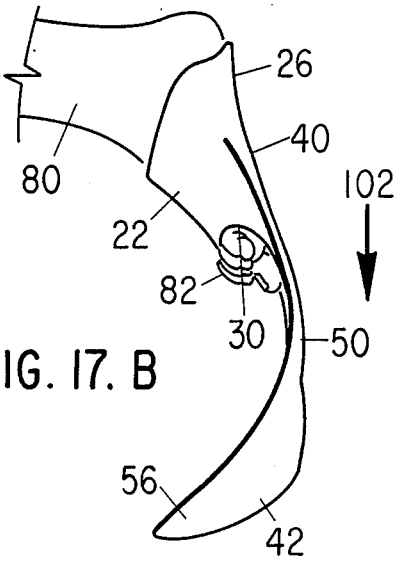
FIG. 17. B
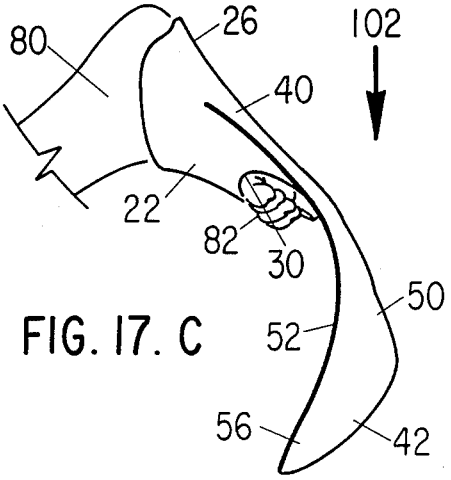
FIG. 17. C
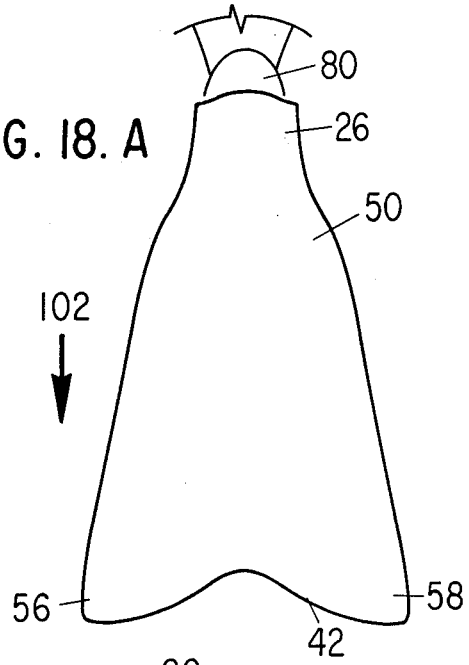
FIG. 18. A
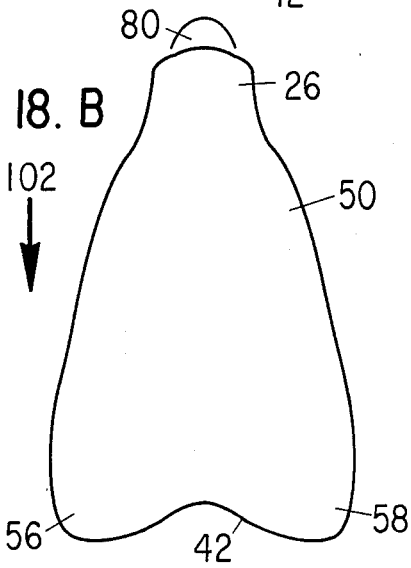
FIG. 18. B
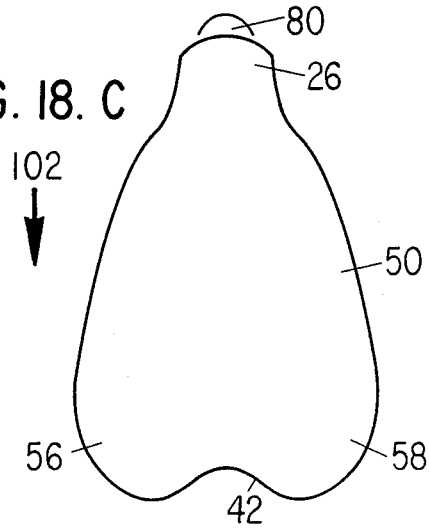
FIG. 18. C

SWIM FIN WITH FLEXIBLE FIN MEMBER HAVING MOVABLE TIPS

This is a continuation of application Ser. No. 06/311,436, filed Oct. 14, 1981, now abandoned.

BACKGROUND OF THE INVENTION

1. Field of the Invention

This invention relates to a swim fin which is adapted to be mounted onto a foot of a swimmer and which has as its primary object the ability of propelling a swimmer through water and more particularly to a swim fin having a foot receiving portion, which is integral with an elongated flexible fin member having movable tips wherein the swim fin is responsive to movement of a swimmer's foot in a direction of the heel to deflect the flexible fin member toward the foot of a swimmer and which is responsive to a reverse kick force produced in response to a movement of a swimmer's foot in a direction toward the swimmer's toe to deflect the elongated flexible fin member in an opposite direction and to move the movable tips along an arcuate path imparting a snapping action thereto and the combination thereof produces a force which propels a swimmer through the water.

2. Description of the Prior Art

It is well known in the art to form a swim fin for a swimmer from a resilient material wherein the swim fin has a foot shoe portion and a fin portion. Certain of the swim fins having a shoe portion are adapted to have either an open toe or a closed toe type of construction depending on the design of the fin. Also, the design of the fin varies widely from fin to fin depending on the objectives and the design thereof.

For example, U.S. Pat. Nos. 4,083,071 and 3,183,529 each disclose a swim flipper wherein the fin portion is formed of a continuous through channel for the flow of water through the fin as a swimmer moves the fin by foot movement to propel the swimmer through the water. The channels provide a means for reducing back pressure when the fin surface is pushed against water enabling a swimmer to use less force during the kicking stroke.

Reissued U.S. Pat. No. Re. 23,006 and U.S. Pat. No. 2,423,571 disclose swim fins wherein the shoe portion encloses the toes to form a continuous outer upper surface of the fin. The fin disclosed in Reissued U.S. Pat. No. 23,006 has a cross-sectional shoe which discloses that the fin is relatively thin in the center of the web and which terminates in relatively thick raised ridges to define a relatively thick rigid edge of the fin member. U.S. Pat. No. 2,423,571 discloses a fin member which is relatively thick at one edge thereof and which tapers in thickness to a relatively thin edge at the other end thereof. At the center of the fin, the thickness of the fin is less than that of the thick edge and greater than that of the thin edge.

The swim fin disclosed in U.S. Pat. No. 2,423,571 permits the fin to experience undulations or serpentine movements wherein the ends of the fin are displaced in a serpentine oscillatory motion to propel a swimmer.

U.S. Pat. Nos. 3,810,269; 3,422,470; 3,239,857; 3,019,458 and 2,737,668 disclose swim fins wherein the foot receiving portion has an open toe end. In the fin portion of the swimmer's foot fin disclosed in U.S. Pat. No. 3,810,269, a rigid center support and two rigid edge supports are provided to insure that the fin member will be held in a relatively fixed position to resist flexing of the fin member.

U.S. Pat. No. 3,422,470 likewise includes a center rib and two edge ribs to provide stiff structure to prevent and retard movement of the fin member. However, apertures having movable flaps are provided in the interior of the web to reduce the force which must be overcome when produced by a swimmer's leg to overcome the force developed by the water resisting movement of the fin by the action of the movable flap within the apertures permiting a certain portion of the water to pass through the apertures thereby reducing the force required to overcome the interaction between the water and surface of the moving fin member.

U.S. Pat. No. 3,239,857 utilizes the concept of a relatively rigid fin member which includes a central support and two edge supports to prevent the fin member from flexing. In addition, the foot shoe portion of the swim fin includes means for enclosing the ankle of a swimmer and to secure the swim fins around the leg of the user to insure that the fin remains on the swimmer during use.

U.S. Pat. No. 3,019,458 discloses a swim fin having a fin member which slopes away from the foot receiving portion at an angle and wherein the fin member has a relatively thin central section, a thicker end section, center ribs to provide support for the central section and relatively thick raised ridges or edges and support around the edges of the fin member. The center ribs and raised edges retard flexing of the fin member in response to movement of the fin by a swimmer in water. The center ribs and raised end edges essentially prevent the fin member from flexing even though the same is at an angle relative to the foot shoe.

U.S. Pat. No. 2,737,668 discloses a swim fin having an open toe and wherein the fin member sides terminate in upwardly curved edges which are integral with the foot shoe portion providing a curved shaped valley which extends upwardly between the shoe portion and edge of the swim fin. The swim fin is permitted to slightly flex at the end thereof to displace the end of the swim fin through a small arcuate shaped angle relative to the shoe portion in order to produce a propeling motion to a swimmer.

SUMMARY OF THE INVENTION

This invention relates to a novel, unique and superior swim fin which is adapted to be mounted onto a foot of a swimmer. In the preferred embodiment, the swim fin includes a foot receiving portion which has a substantially planar base section which terminates at one end thereof in an integrally downwardly extending heel section and which terminates at the other end thereof in an open toe section. The foot receiving portion constricts only the bony mass of the foot and leaves the metatarsals and phalanges free from enclosure. The elongated flexible fin member is formed of a resilient material and is integral with and extends from the substantially planar base section of the foot receiving portion. The elongated flexible fin member is generally trapezoidal in shape and has a short end, a larger deflectable end, sloping sides and an upper surface and lower surface. The short end of the elongated flexible fin member is positioned adjacent the open toe section of the foot receiving portion. The deflectable end of the elongated flexible fin member terminates in a pair of spaced movable tips. The elongated flexible fin member has, along a line normal to a center line extending substantially perpendicular between the short end and the deflectable end of the elongated flexible fin member, a cross-sectional shape which is thicker in the center thereof and which tapers in thickness from the center thereof to each sloping side to define a relatively thin flexible edge along each sloping side of the elongated flexible fin member. The elongated flexible fin member is responsive to a force being urged against the lower surface thereof to flex its deflectable end including the movable tips formed thereon through an arcuate shaped path towards the open toe section and is responsive to an abrupt reversal in the urging force from the lower surface to the upper surface to immediately deflect the deflectable end of the elongated flexible fin member towards the heel portion of the foot receiving portion. This moves the movable tips along an arcuate shaped path as the deflectable end is urged toward the heel section causing the movable tips to exhibit a snapping action wherein the movable tips are abruptly reversed in direction and extend towards the heel section of the foot receiving portion. The combination of the deflection of the deflectable end and the snapping action of the movable tips are capable of producing a propelling force as the elongated flexible fin member is subjected to abrupt reversals of forces on its upper surface and lower surface.

The present invention overcomes several of the inherent disadvantages and problems associated with the prior art devices.

Typically, the prior art swim fins having a foot shoe portion and a fin portion function in a manner such that as the swimmer's foot is moved in a direction toward its heel that the known prior art swim fins produce a power stroke as the leg is being lifted. When the swimmer reverses the power by reversing direction of the kick, the foot is then moved in the direction towards the toes which pushes the surface of the swim fin into contact with the water and the swimmer must exert sufficient force during the movement of the leg to override the force being urged against the swim fin by water pressure in order to move the swim fin through a sufficient arc in order to commence a subsequent power stroke. In the known prior art swim fins, the power stroke essentially relates to that portion of a swimmer's motion wherein the fin is moved from its position essentially below the swimmer's body when the fin is moved in a direction towards the heels of a swimmer's body and the leg is moved from below the swimmer's body up to a position substantially parallel with the swimmer's body and the power stroke occurs and the propelling force is produced by the action of the lower surface of the fin pushing against the water.

Typically, the prior art swim fins are designed to have a relatively rigid or stiff web member such that the web portion does not flex at all or if it does flex only flexes through a very limited acute angle. The reason that the prior art swim fins are held substantially rigidly in place is due to the fact that it is necessary for a swimmer to exert sufficient force during the upward power stroke in order to produce a propelling force to move the swimmer through the water. Certain of the prior art swim fins, such as those described in U.S. Pat. Nos. 3,083,071 and 3,183,529, sought to overcome the pressure problem which develops between the lower surface of a fin and water during a resetting stroke and the force required to be exerted by a swimmer's leg is reduced by forming a water channel through which the water can flow to reduce the back pressure or by providing apertures having flaps which permit a portion of the water to flow therethrough to reduce the amount of force which a swimmer's leg must exert in order to overcome the action between the upper surface of a fin and the water during a reset stroke.

The swim fin of the present invention is novel and unique because it operates in a manner which is substantially opposite to that of the prior art devices. Specifically, during the portion of a stroke which would be considered the power stroke by the prior art swim fins, that portion of the stroke would be considered the reset stroke. Conversely, what traditionally is the reset stroke for the prior art swim fins is the power stroke for the present fin such that the swim fin of the present invention produces a propelling force during the portion of a swimmer's stroke when a swimmer's leg is moved from a position substantially parallel with that of the swimmer's body into a position where the foot is located below the swimmer's body.

Thus, one advantage of the present invention is that the swim fin includes an elongated flexible fin member which flexes during a reset stroke so as to reduce the amount of energy required by a swimmer in moving the fin from the end of a power stroke position during a reset stroke position into an initial position required to commence a subsequent power stroke.

Another advantage of the present invention is that a propelling force is developed by a swimmer by moving its foot from a position which is substantially parallel to the body of the swimmer to a position where the foot ends up below the body and wherein the propelling force is developed by a combination of the flexing of a deflectable end and the snapping action of movable tips formed on the deflectable end which in combination produce a propelling force to move the swimmer ahead through water.

A further advantage of the present invention is that a swim fin constructed using the teachings herein can be made of a smaller size and of lighter weight.

a yet further advantage of the present invention is that the swim fin can be utilized without the necessity of a strap, or, if a strap is lost, the swim fin will remain on a swimmer's foot due to the direction of the force vectors urging the fin thereagainst during the power stroke.

Yet a further advantage of the present invention is that the swim fin can have its foot receiving portion and its elongated flexible fin portion formed of a resilient material which is molded into an integral one piece molding of the resilient material.

A still yet further advantage of the present invention is that the resiliency of the material and the thickness of the cross-sectional shape of the elongated flexible fin member can be controlled to produce various deflecting characteristics of the deflectable end and movable tips so as to control the power, maneuverability and angle of deflections of the deflectable end portion and movable tips to determine and control the amount of power produced by each power stroke.

A still yet further advantage of the present invention is that the elongated flexible fin member can have its deflectable end portion including the movable tips deflected along an acute angular path directed toward the open toe section of the foot receiving portion and then be subject to an abrupt reversal of force which would immediately cause the foot receiving portion to be deflected in a direction opposite to its original direction of deflection causing the movable tips to be moved through an arcuate shaped path and during movement of the movable tips along the arcuate shaped path the movable tips are subjected to a snapping action wherein the movable tips abruptly change direction and are deflected toward the heel section of the foot receiving portion of the swim fin.

A still yet further advantage of the present invention is that a swimmer can be subjected to propelling forces developed from the combined action of both the deflection of the deflectable end and snapping action of the movable tips to produce a propelling force on a swimmer during the time a swimmer's foot is moved from a lower position to a position substantially parallel with the swimmer's body.

A still yet further advantage of the present invention is that the edges of the elongated flexible fin member are relatively thin such that if one edge is moved adjacent to or passes by the edge of an opposite swim fin located on another foot, that the water passing therebetween will actually cause a deflection of the adjacent edges to permit one fin to traverse pass the other fin without engagement or contact therebetween.

BRIEF DESCRIPTION OF THE DRAWING

The foregoing and other advantages and features of this invention will become apparent from the following description of the preferred embodiment when considered together with the illustrations and accompanying drawing which include the following figures:

FIGS. 15*a*, 15*b* and 15*c* are pictorial representations of an end view of the power stroke of a swimmer using the swim fin of FIG. 1;

FIGS. 16*a*, 16*b* and 16*c* are pictorial representations of an end view of the swim fin during the respective positions of the fin during the power stroke as illustrated in FIGS. 15*a*, 15*b* and 15*c*, respectively;

FIGS. 17*a*, 17*b* and 17*c* are pictorial representations of the swim fin of FIG. 1 during a reset stroke; and FIGS. 18*a*, 18*b* and 18*c* are pictorial representations of a bottom view of the swim fin during respective positions of the reset stroke and correspond to FIGS. 17*a*, 17*b* and 17*c*, respectively.

DESCRIPTION OF THE PREFERRED EMBODIMENT

Figure 1:
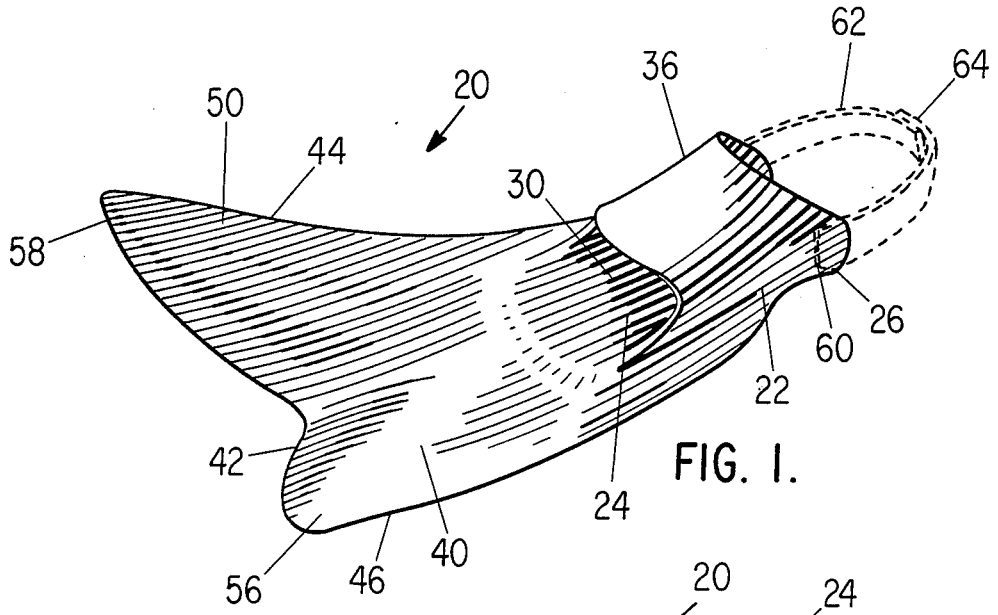
FIG. 1 is a top perspective view of a swim fin showing a foot receiving portion and elongated flexible fin member.

FIG. 1 illustrates a swim fin shown generally by arrow 20 is adapted to be mounted onto a foot of a swimmer. The swim fin of the present invention has as its object the ability of propelling a swimmer through water. In using the fins of the present invention, a swimmer will normally utilize his legs to develop a kick stroke. In developing a kick stroke, the foot of a swimmer is displaced from a position which is normally in the plane of the body into a position where the foot is located at a position below the plane of the body and the legs are pivoted above the hip socket to move the leg, foot and swim fin affixed to the foot through a predetermined angle. For purposes of this description, a "power stroke" refers to that portion of a swimmer's movement wherein the foot and its fin is moved from a position which is substantially planar to the position of the swimmer's body to a position where the foot and fin are moved to a point located below the swimmer's body and further into the water. The term "reset stroke" refers to that portion of the kicking action wherein the foot of a swimmer is moved from the position located at a point below the plane of the swimmer's body and in the water to a position wherein the foot and its associated fin are moved to a point which is in a plane substantially parallel to the plane of the swimmer's body.

Figure 2:
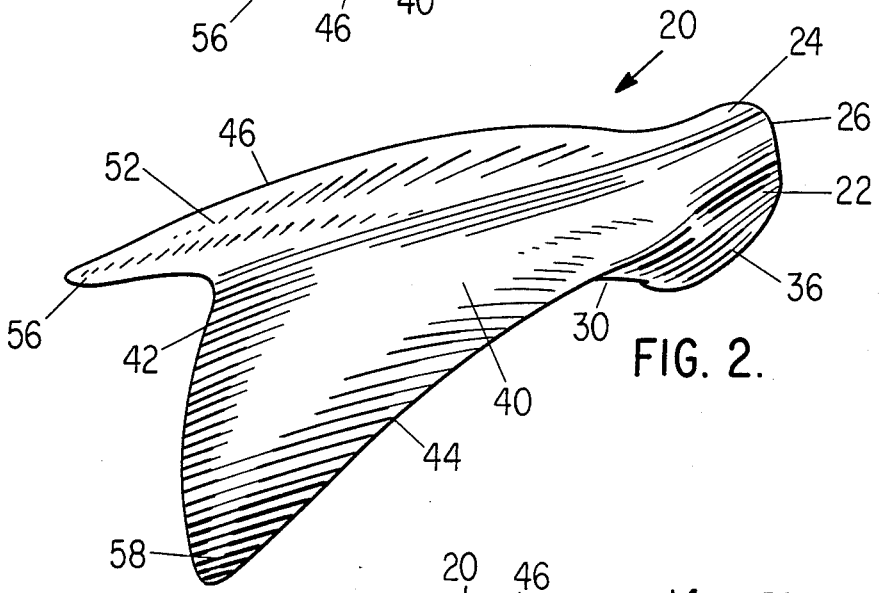
FIG. 2 is a bottom perspective view of the swim fin of FIG. 1.

Referring again to FIG. 1, the swim fin 20 includes a foot receiving portion shown generally as 22, which has a substantially planar base section 24 which terminates at one end thereof in an integrally downwardly extending heel section 26, which is shown in better detail in FIG. 2, and which terminates at the other end thereof in an open toe section 30.

In the preferred embodiment, the foot receiving portion 22 may include a resilient flexible upper section 36 which is adapted to enclose the upper portion of swimmer's foot. The end of the resilient flexible upper section terminates in an end which defines an upper portion of the open toe section 30 of the foot receiving portion 22.

The swim fin 20 includes an elongated flexible fin member, shown generally as 40, which is formed of a resilient material, such as, for example, polyurethane. The elongated flexible fin member 40 extends from the substantially planar base section 24 of the foot receiving portion 22. The elongated flexible fin member 40 is generally trapezoidal in shape and has a short end which is integral with the substantially planar base section 24. The elongated flexible fin member 40 has a larger deflectable end 42, sloping sides 44 and 46, and an upper surface 50 and lower surface 52. The shorter or smaller end of the elongated flexible fin member 40 is integral with the substantially planar base section 24 and extends outwardly therefrom and is adjacent the open toe section 30 of the foot receiving portion 22. The deflectable end 42 terminates in a pair of spaced movable tips 56 and 58.

Figure 3:
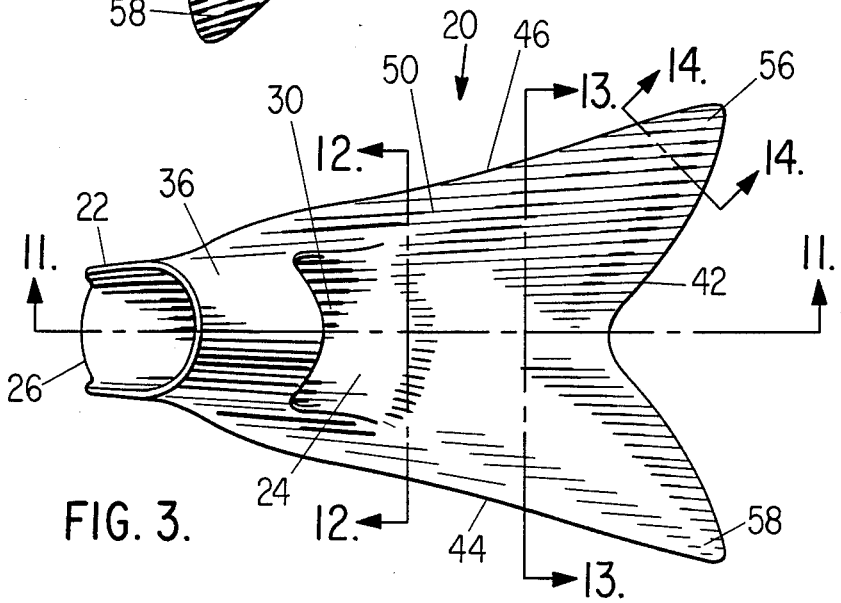
FIG. 3 is a top plan view of a swim fin having a foot receiving portion and elongated flexible fin member which terminates in a pair of spaced movable tips.

FIGS. 2 and 3 show each of the above components and the relationship of the foot receiving portion 22 relative to the elongated flexible fin member 40. As illustrated in FIG. 3, the movable tips 56 and 58 are symmetrical and substantially the same length. The movable tips 56 and 58 cooperate with the deflectable end 42 so as to form a "V" shaped deflectable edge which enables the movable tips 56 and 58 to have the edges thereof extend beyond the nominal deflection edge formed by the trapezoidal shaped elongated flexible fin member 40. The center line of each of the movable tips 56 and 58 are essentially positioned at an acute angle relative to the center line of the swim fin which traverses along a line which is substantially perpendicular between the smaller end of the substantially trapezoidal shaped elongated flexible fin member and the other end thereof which defines the deflectable end. Also, FIGS. 1, 2 and 3 illustrate that the upper surface 50 and lower surface 52 have a thickness which varies from its relatively thick center section as it tapers off toward the sloping ends wherein the sloping ends have a relatively thin edge.

Referring again to FIG. 1, the foot receiving portion 22 may include a pair of spaced parallel slots such as the slots shown in phantom as 60 which are located adjacent the integrally downwardly extending heel section 26. A strap member shown by phantom strap 62 may include fastening means shown by phantom fastening means 64 which may be a velcro fastener. The strap member 62 passes through the parallel slots 60 and is adapted to be attached to the foot receiving portion 22. The strap member 62 is adapted to be fastened by the fastening means 64 to hold a swimmer's foot securely within the foot receiving portion 22 enabling the toes of a swimmer to extend through and beyond the open toe section 30 of the foot receiving portion 22.

In the preferred embodiment, the force developed during the power stroke by a swimmer results in the foot receiving portion of the fin being urged tightly against the foot of a swimmer such that the swimming fin will remain on the swimmer's foot without the need of a strap of fastening means. However, in order to provide additional security so that a fin will not fall off when the user is not swimming or so that contact with other objects will not pull the fin off of the swimmer, the strap member and fastening means may be utilized to maintain the swim fin in engagement with the swimmer's foot.

Figure 4:
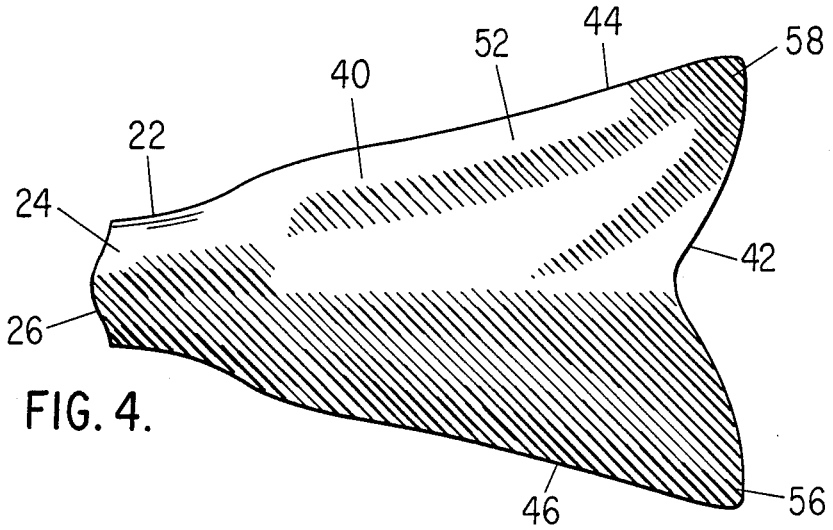
FIG. 4 is a bottom plan view of the swim fin of FIG. 3.
Figure 5:
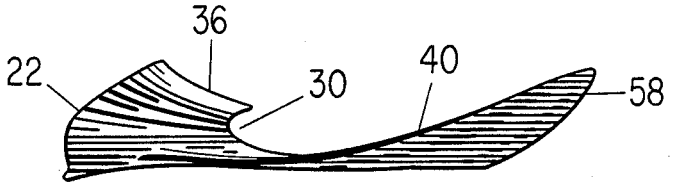
FIG. 5 is a right elevational view of the swim fin of FIG. 3.
Figure 6:
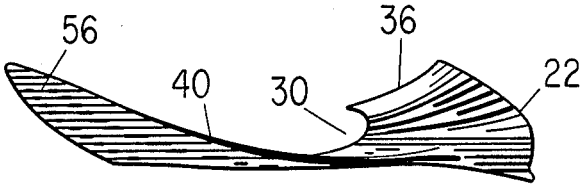
FIG. 6 is a left elevational view of the swim fin of FIG. 3.
Figure 7:
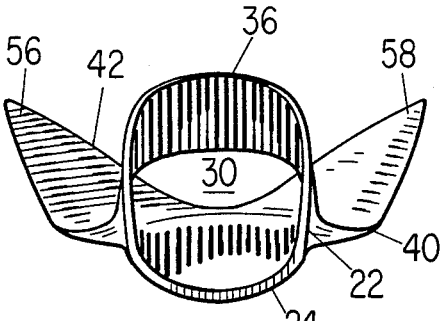
FIG. 7 is an end view of the swim fin of FIG. 5.
Figure 8:
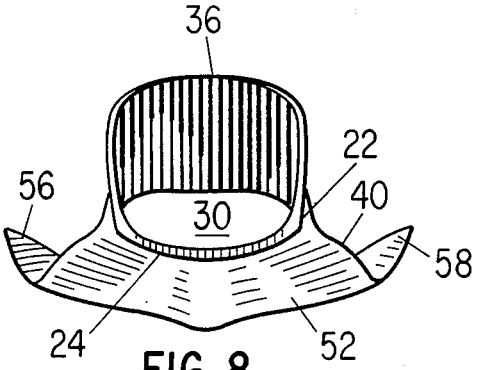
FIG. 8 is an end view of the swim fin of FIG. 5 wherein the foot receiving portion is tilted upwardly relative to the deflectable end of the elongated flexible fin member.

FIG. 4 shows the relationship between the lower surface 52 of the elongated flexible fin member 40 and the relationship between the substantially planar base section 24 which terminates in the integrally downwardly extending heel section 26. The sloping sides 44 and 46 and the deflecting end 42 together with the smaller end of the elongated flexible fin member 40 which is integral with the substantially planar base section 24 define a generally trapezoidal shaped element.

FIGS. 5, 6, 7 and 8 illustrate the relationship between the foot receiving portion 22, the elongated flexible fin member 40 and the resilient flexible upper section 36 of the foot receiving portion 22. As illustrated in FIG. 4, the outwardly extending movable tips 56 and 58 form a substantially "V" shaped deflection edge 42. In the end view illustrated in FIG. 7, the deflection formed by the outwardly extending movable tips 56 and 58 relative to the deflection edge 42 is that the deflection end forms an arcuate shaped edge relative to the substantially planar base section 24 of the foot receiving portion 22.

Figure 9:
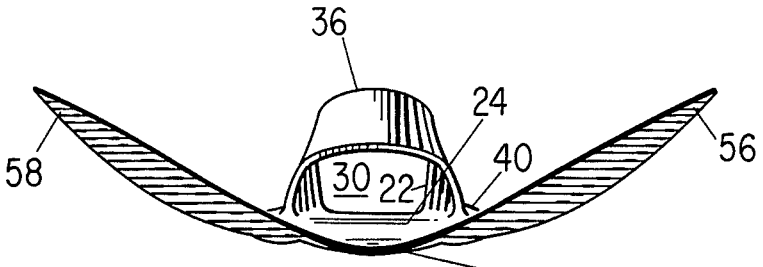
FIG. 9 is a front view of the swim fin of FIG. 5.
Figure 10:
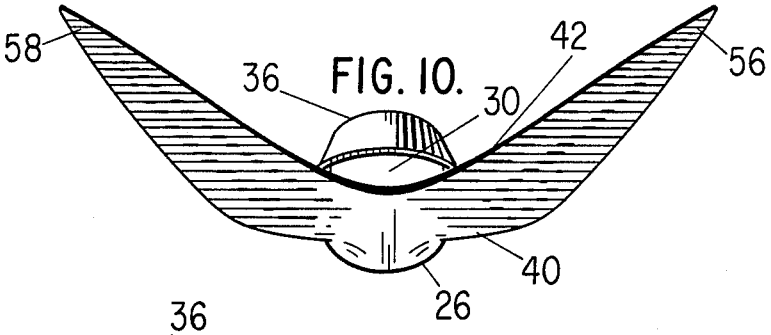
FIG. 10 is a front view of the swim fin of FIG. 5 wherein the deflectable end is rotated upwardly relative to the foot receiving portion.

FIGS. 9 and 10 show the relationship between the elongated flexible fin member 40 relative to the foot receiving portion 22. FIGS. 9 and 10 illustrate that the upwardly extending movable tips 56 and 58 produce a deflectable end 42 which is arcuate in shape relative to the substantially planar base section 24. As illustrated in FIG. 10, the integrally downwardly extending heel section 26 is disposed and extends below the surface defined by the substantially planar base section 24 and the elongated flexible fin member 40 which extends therefrom.

Figure 11:
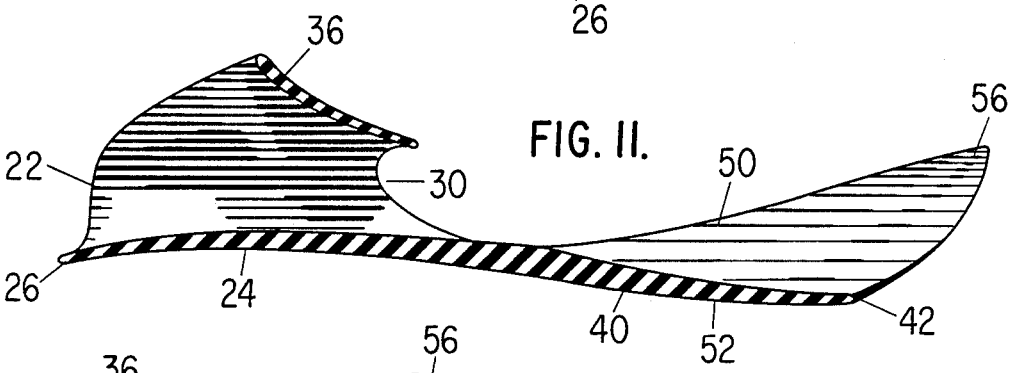
FIG. 11 is a section of the swim fin taken along section lines 11—11 of FIG. 3.

FIG. 11 shows in detail the relationship of the relative thickness of the substantially planar base section 24, the thickness of the integrally downwardly extending heel section 26 and overall thickness of the elongated flexible fin member 40. The resilient flexible upper section 36 is relatively thin in cross-section compared to the thickness of the substantially planar base section 24. The elongated flexible fin member 40 extends from the substantially planar base section 24 and is slightly thicker in approximately the center thereof and then decreases or tapers in thickness as it approaches the deflectable end 42. Also, by varying the thickness of the elongated flexible fin member 40 and the overall length thereof, the elongated flexible fin member 40 can have different fluctuate characteristics such that the degree of fluctuation, the amount of force generated and the amount of force required to produce a propelling force can be established by controlling the thickness and length of the elongated flexible fin member 40. In the preferred embodiment, the length of each of the movable tips is equal to approximately 25% of the distance between the short end and the deflectable end of the elongated fin member.

Figure 12:
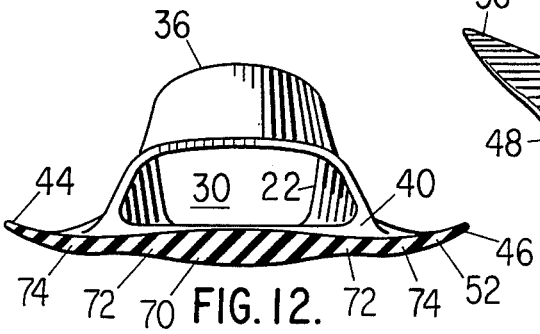
FIG. 12 is a section of the swim fin taken along sections lines 12—12 of FIG. 3.
Figure 13:
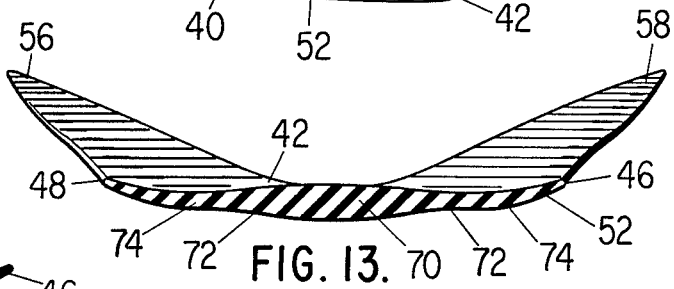
FIG. 13 is a section of the swim fin taken along section lines 13—13 of FIG. 3.

FIGS. 12 and 13 illustrate the cross-sectional shape of the elongated flexible fin member 40 along a line which is normal to the center line extending substantially perpendicular between the short end of the elongated flexible fin member 40 which is integral with the substantially planar base section 24 and the deflectable end 42. As illustrated in FIGS. 12 and 13, the cross-sectional shape is thicker in the center thereof as shown by enter thickness 70 and tapers in thickness from the center thickness 70 to each of the sloping sides 46 and 48 to define a relatively thin flexible edge along each of the sloping sides 46 and 48 of the elongated flexible fin member 40.

In the preferred embodiment, the thickness of the cross-sectional shape illustrated in FIGS. 12 and 13 varies from its thickness at the center thickness 70 to a relatively thin thickness 72 to define a valley in each side of the lower surface 52 of the elongated flexible fin member 40 and then back to a slightly greater thickness as shown by thickness 74 which tapers in thickness from each valley to the thin edge of each of the sloping sides 44 and 46 of the elongated flexible fin member 40.

Figure 14:
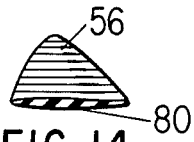
FIG. 14 is a section of the movable tips taken along section 14—14 of FIG. 3.

FIG. 14 illustrates the thickness of the upwardly extending movable tip 56 which has a relatively thicker center portion 80 which likewise tapers off into and defines relatively thin edges for the movable tip 56. The construction of movable tip 58 is substantially identical to that illustrated in FIG. 14.

FIGS. 15*a*, 15*b* and 15*c* and their corresponding FIGS. 16*a*, 16*b* and 16*c*, respectively, show the position of the swim fin 20 at the beginning, intermediate and bottom part of the power stroke. The illustrations in FIGS. 15(a), 15 (b) and 15(c) are shown based upon the foot and side of the elongated fin being observed from the same location for each position. Likewise, FIGS. 16(a), 16(b) and 16(c) are illustrations based upon the foot and the end of the elongated fin being observed from the same location for each position. As illustrated in FIG. 15*a*, the swimmer's foot 50 is positioned within the foot receiving portion 22 such that the swimmer's toes 82 extend through the open toe section 30. As the foot 80 of the swimmer is moved in any direction toward the toes 82, the upper surface 50 of the elongated flexible fin member 40 is urged against the water which generates a force in the direction shown by arrow 100. The force represented by arrow 100 deflects the deflectable end 42 away from the open toe section 30 of the foot receiving portion 22 and causes the upwardly extending movable tips 56 and 58 to snap and deflect in a direction toward the integrally downwardly extending heel section 26. FIG. 16a illustrates pictorially the deflection of the deflectable end 42 and the snapping action of the upwardly extending movable tips 56 and 58.

FIGS. **15*b* and 16*b* illustrate the foot of the swimmer at a position midway during the power stroke. As illustrated in FIG. 15*b*, the force of the water illustrated by arrow 100 deflects the elongated flexible fin member 40 such that the movable tips 56 and 58 are deflected along an arcuate path towards the integrally downwardly extending heel section 26. The deflection of the elongated flexible fin member 40 combined with the snapping action of the upwardly extending movable tips 56 and 58 generate a propelling force which moves the swimmer through the water. FIG. 16b illustrates that the deflected end 42 and the upwardly extending movable tips 56 and 58 have undergone a snapping action to generate the propulsion force and that the same are deflected toward the integrally downwardly extending heel section 26**.

FIG. **15*c* illustrates the foot of a swimmer at the end of a power stroke. The force generated by the water illustrated by arrow 100 is urged against the upper surface 50 which urges the elongated flexible fin member 40 such that the deflectable end 42 and the upwardly extending movable tips 56 and 58 are located at a distance which is spaced from and substantially parallel to the integrally downwardly extending heel section 26**.

As illustrated in FIGS. **15*a*, 15*b* and 15*c* and their associated FIGS. 16*a*, 16*b* and 16*c*, respectively, the propelling force is generated by the deflection of the deflectable end 42 against the water force illustrated by arrow 100 and the snapping action of the upwardly extending movable tips 56 and 58** to propel the swimmer ahead.

FIGS. **17*a*, 17*b* and 17*c*** illustrate the "reset stroke" with the foot of the swimmer located at the beginning, center and end of the reset stroke, respectively.

FIG. **17*a* illustrates that as the foot of the swimmer 80 is moved in a direction toward the heel that the force of the water represented by arrow 102 is urged against the lower surface 50 which urges the deflectable end 42 toward the toes 82 and causes the upwardly extending movable tips 56 and 58 to be deflected toward each other which has the effect of reducing the total surface of the elongated flexible fin member 40** which is in contact with and reacts with the water.

FIG. **18*a* illustrates the lower surface 50 of the elongated flexible fin member 40** which engages the water during the reset stroke.

FIG. **17*b* illustrates that as the foot 80 of the swimmer is moved into its intermediate position that the deflectable end 42 and the upwardly extending movable tips 56 and 58 are urged along an arcuate shaped path toward the toes 82 and the open end 30 by the force of the water illustrated by arrow 102**.

FIG. **18*b* illustrates that the total cross-sectional area of the lower surface 50 which is presented to the water is less than that as illustrated in FIG. 18*a***.

FIG. **17*c* illustrates the position of the foot 80 of a swimmer at the end of the reset stroke wherein the force generated by the water illustrated by the arrow 102 has caused the deflectable end 42 and the upwardly extending movable tips 56 and 58 to be deflected forward approximately 45°. The upwardly extending movable tips 56 and 58 form an arcuate shaped cup member which retains a substantial volume of water and which generates a slightly negative pressure on the inner surface 52 due to the fact that the water is moving across and spills across the lower surface 50 and across the upwardly extending movable tips 56 and 58. FIG. 18*c* illustrates that the total cross-sectional area of the elongated flexible fin member 40 which is presented to the water is substantially reduced in size and that the flexible ends have been urged forward to rotate or move the upwardly extending movable tips 56 and 58 through an arcuate shaped path toward the open toe section 30**.

At the end of the reset stroke, the swimmer abruptly reverses the direction of foot movement which results in an abrupt reversal of the force generated by the water being reversed from the lower surface 50 to the upper surface 52. When the swimmer reverses the stroke, the deflectable end 42 is deflected from a substantially forward position illustrated in FIG. **17*c* to an opposite deflected position illustrated in FIG. 15*a*, which switch in condition occurs abruptly. As the deflectable end 42 is deflected from its forward position illustrated in FIG. 17*c* to its rearward position illustrated in FIG. 15*a*, the upwardly extending movable tips 56 and 58 are moved in an arcuate shaped path which causes a "snapping action" of the upwardly extending movable tips 56 and 58. The combination of the deflection of the deflectable end 42 and the "snapping action" of the moveable tips 56 and 58 produces the propelling motion as discussed in connection with FIGS. 15*a*, 15*b*, 15*c* and its associated FIGS. 16*a*, 16*b* and 16*c***, respectively.

It is envisioned that by selecting ratios of the length of the elongated flexible fin member, the general shape of the trapezoidal area, the length of the upwardly extending movable tips and the cross-sectional thickness of the elongated flexible fin member, a wide range of fins for different types of applications can be produced. For example, for swimming, it may be desirable to have a relatively short lightweight fin having a small cross-sectional area and a small upper surface and lower surface to propel a swimmer in a forward direction. Also, a fairly heavy duty high powered swim fin can be produced for commercial diving purposes wherein the length of the elongated flexible fin member can be substantially greater than that for swimming purposes, that the small end and larger deflectable end can have different selected ratios, that the thickness of the cross-sectional shape of the elongated flexible fin member can be varied to provide the desired degree of stiffness and fluctuation as required in order to support a diver, divers equipment and working equipment.

It is also envisioned that by using the teachings of the present invention, that the size of the fins, the amount of force and the ratio of fin size to swimmer size can be selected such that the amount of energy and force to be expended by a swimmer can be optimized and that the leg muscles of a swimmer can be developed to utilize the fins of the present invention which have a different "power stroke" than the power stroke of the known prior art devices.

What is claimed is:

1. A swim fin adapted to be mounted onto a foot of a swimmer comprising a foot receiving portion having a substantially planar base section terminating at one end thereof in an integrally downwardly extending heel section and terminating at the other end thereof in an open toe section which encloses only the upper portion of the foot;

an elongated flexible fin member formed of a resilient material and being integral with and extending from said substantially planar base section of the foot receiving portion, said elongated flexible fin member being generally trapezoidal in shape having a short end, a deflectable end, sloping sides and an upper surface and a lower surface with the short end thereof positioned adjacent the open toe section of said foot receiving portion and with the deflectable end thereof terminating in a pair of upwardly extending, symmetrically spaced movable tips, which are deflectable, said elongated flexible fin member having along a line normal to a center line extending substantially perpendicular between said short end and said deflectable end of the elongated flexible fin member a cross-sectional shape which varies its thickness from a center thickness to a relatively smaller thickness to define a valley in each side of the lower surface of the elongated flexible fin member and then back to a slightly greater thickness which then tapers from each such greater thickness to the thin edge of each of the sloping sides of said elongated flexible fin member;

said elongated flexible fin member being responsive to a force being urged against the upper surface thereof to flex its deflectable end including the movable tips formed thereon through an arcuate shaped path curling away from the open toe section and toward the heel section creating a build-up of water pressure within the flexed lower surface and being responsive to a reaction force produced by the thicker portions of the lower surface when the force being urged against the upper surface is discontinued which reaction force immediately deflects the deflectable end of said elongated flexible fin member causing the movable tips to exhibit a snapping action wherein the movable tips abruptly reverse direction terminating with the movable tips collapsing the upper portion of the elongated flexible fin member into a v-shape formed from the center line portion of the fin and extending to the movable tips of the elongated flexible fin member wherein the combination of the flexing of the deflectable end and the snapping action of the movable tips produces a propelling force as water is channeled from the thin edges adjacent to the foot pocket over the valleys of the lower surface and through the v-shape of the movable tips collapsed from the center line and over and under the tapered edges of the lower and upper surfaces of the elongated flexible fin member.

2. The swim fin of claim 1 wherein said foot receiving portion is formed of a resilient flexible material.

3. The swim fin of claim 2 wherein said foot receiving portion and said elongated flexible fin member are formed as an integral one piece molding of resilient material.

4. The swim fin of claim 3 wherein said resilient material is a polyurethane.

5. The flexible fin member of claim 2 wherein said foot receiving portion includes a resilient flexible upper section which is adapted to enclose only the bony mass of a foot allowing the flexible fin member to curl away from the open toe section.

6. The swim fin of claim 1 wherein said movable tips are deflected along an arcuate shaped path of approximately 45 degrees relative to the substantially planar base section of the foot receiving portion in response to a force being urged against the upper surface of the elongated flexible fin member and wherein the movable tips are deflected along an arcuate shaped path of approximately 180 degrees relative to said substantially planar base section of said foot receiving portion in response to the build-up of water pressure within the flexed lower surface either alternately or in addition to the reaction force produced by the center thicknesses of the lower surfaces of the elongated flexible fin member.

7. The swim fin of claim 1 wherein the thickness of said cross-sectional shape varies from its thickness at the central portion thereof to a relatively thin thickness for a short distance on each side thereof to define said valley in each side of the lower surface which valleys extend forwardly to the outermost tip of the deflectable ends of the elongated flexible fin member and then back to a slightly greater thickness which tapers in thickness from each such greater thickness to each thin edge of each of the sloping sides of said elongated flexible fin member the thinner portions of the lower surfaces and tapered edges of the upper and lower surfaces allow for directional flow of water.

8. The swim fin of claim 1 wherein the length of each of the movable tips are equal to approximately 25% of the length of the distance between the short end and the deflectable end of the elongated flexible fin member.

9. The swim fin of claim 8 wherein the center line of each of the movable tips is disposed at an acute upward angle relative to the center line of the elongated flexible fin member to provide resistance on the power stroke and to limit resistance when collapsing towards the upper surface on the reset stroke.

10. The swim fin of claim 8 further comprising means defining a pair of spaced parallel slots in said foot receiving portion adjacent said integrally downward extending heel section; and a strap member including fastening means which passes through said parallel slots and which is adapted to attach said foot receiving portion and which is adapted to be fastened together by said fastening means to hold a swimmer's foot securely within said foot receiving portion enabling toes of a swimmer to extend through and beyond the open toe section of the foot receiving portion.

11. A swim fin formed of a resilient flexible material in an integral one piece molding comprising a foot receiving portion having a substantially planar base section and a downwardly extending heel section;

an elongated flexible fin member being generally trapezoidal in shape having the smaller end thereof positioned contiguous to and extending from said substantially planar base section and having the larger end thereof terminating in a deflectable end which defines a pair of upwardly extending movable tips, said elongated flexible fin member having a selected thickness at the central portion thereof which tapers in thickness therefrom and to each side of the flexible fin to define a selectively thin flexible edge along each side;

said elongated flexible fin member being deflected in a first direction curling away from said foot receiving portion as the foot of a swimmer moves down during power stroke and then being abruptly deflected at the end of the power stroke in a second direction moving the deflectable end and the movable tips formed thereon along an arcing path which imparts a snapping action to the movable tips wherein the combination of the deflection of the deflectable end and the "snapping action" of the movable tips provides a propelling force in a predetermined direction.

* * * * *